US005081950A

United States Patent [19]

Martin et al.

[11] Patent Number: 5,081,950

[45] Date of Patent: Jan. 21, 1992

[54] COATING DEVICE

[75] Inventors: Eckhard Martin, Hunxe; Joachim Wiesse, Wesel, both of Fed. Rep. of Germany

[73] Assignee: J. M. Voith GmbH, Heidenheim, Fed. Rep. of Germany

[21] Appl. No.: 534,940

[22] Filed: Jun. 8, 1990

[30] Foreign Application Priority Data

Jun. 10, 1989 [DE] Fed. Rep. of Germany ..... 3919087

[51] Int. Cl.[5] ..... B05C 11/02

[52] U.S. Cl. ..... 118/70; 118/104; 118/106; 118/126; 118/257

[58] Field of Search ..... 118/70, 104, 203, 106, 118/107, 257, 261, 203, 1-12, 118, 119, 123, 126, 248

[56] References Cited

U.S. PATENT DOCUMENTS 3,781,107 12/1973 Ruhland ..... 118/106
3,958,531 5/1976 Warne ..... 118/106
4,651,672 3/1987 Sommer ..... 118/261
4,665,859 5/1987 Dunlap et al. ..... 118/261
4,938,131 7/1990 Maggi ..... 118/261

FOREIGN PATENT DOCUMENTS 2150907 4/1973 Fed. Rep. of Germany ..... 118/261
2822683 11/1979 Fed. Rep. of Germany .

*Primary Examiner*—Jay H. Woo
*Assistant Examiner*—Khanh P. Nguyen
*Attorney, Agent, or Firm*—Baker & Daniels

[57] ABSTRACT

A coating device for a material web, such as a paper or cardboard web, is provided. A doctor band, serving as a doctor element, is run over reversing rolls in the form of a loop and along a backing roll that supports the material web. A doctor band drive is provided by take-up drums that can be driven by a motor. The feed of the doctor band is very low, for instance, 2 to 10 cm/min. This provides sufficient time for performing a thorough cleaning of the doctor band. The band may be cleaned by nozzles, scrapers and the like.

24 Claims, 2 Drawing Sheets

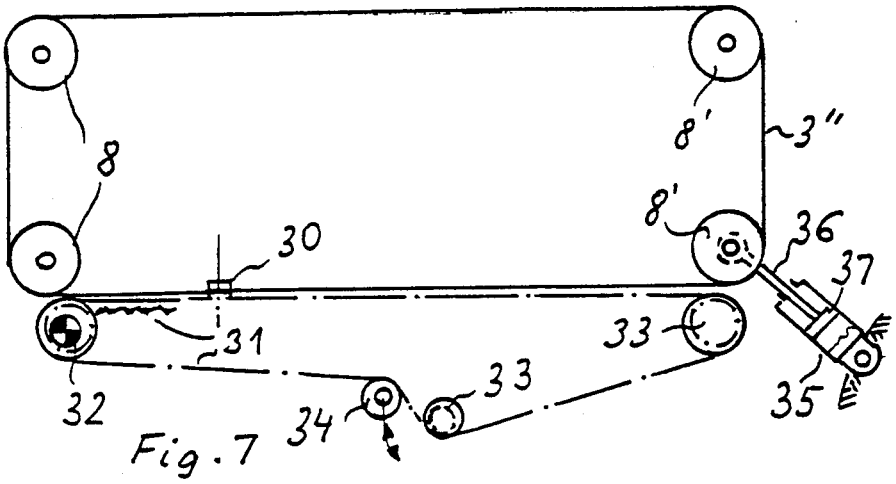
Fig. 7
Fig. 5
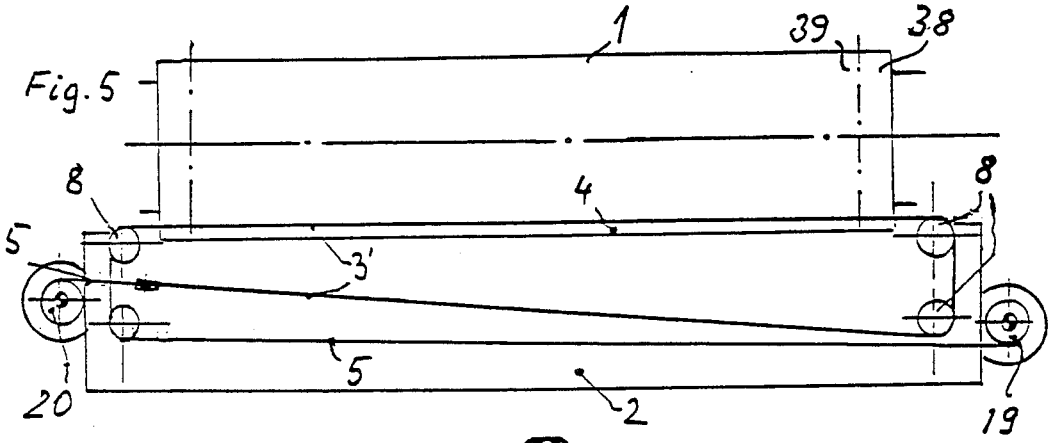
Fig. 6
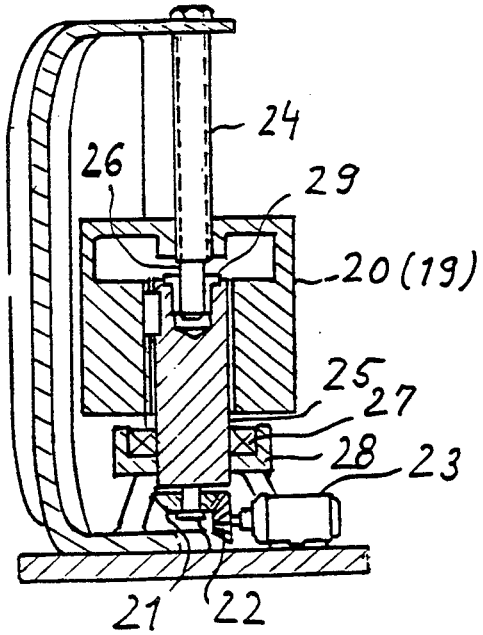

COATING DEVICE

BACKGROUND OF THE INVENTION

The invention concerns a coating device for the coating of a web material, such as paper or cardboard webs, that are supported, preferably, by a backing roll. The coating device includes a doctor fashioned as a doctor blade band which is retained in a doctor holder supported by a doctor beam.

Coating devices for web material are known in the prior art. In prior art devices a blade may be used, which smoothes the coating substance that is applied on the web. Either a round doctor bar or also a doctor blade may the used as a doctor. Both elements have their specific applications, although the blade involves the grave disadvantage of heavy, partly disuniform wear.

It has frequently been found that the coating application in the case of a blade displays disuniformities that do not occur with a roll type doctor. Attempts have been made, with the aid of profile correction devices that permit a local variation of the contact pressure applied on the blade, to accomplish a uniformity of the coating. This has not, however, always been completely successful. Accordingly, the problem underlying the present invention is to provide a device where a uniform coating application is also achieved during the entire operation.

SUMMARY OF THE INVENTION

This problem is solved through the features of the present invention. A coating device for the coating of a web supported by a backing roll is provided. The coating device comprises a doctor band retained in a doctor holder which is supported by a doctor beam. The doctor band has a working area along said backing roll for coating said web. The working area of the doctor band has two longitudinal ends and is movably held in a straightline doctor guide. The doctor band further has excess areas that border on and extend beyond each of the longitudinal ends of the working area. The doctor band is at least partly curved in said excess areas so as to limit the doctor band to a length of maximally 1.6 times greater than the length of the straightline doctor guide. Drive means for feeding the doctor band, including particularly that portion of the doctor band contained in the doctor guide, in a longitudinal direction along said backing roll is also provided.

It has been realized that it is possible, through sideways retraction of a coating band that is considerably longer than what constitutes the working length (the working area) of the coating blade, to continuously clean the blade and thus eliminate concentrations on the blade that lead to streaking.

According to the Swedish patent document 436,593, scrap blades have been previously designed in the form of a relatively long band running on reels, and have been designed to continuously vary the working range of the scraper blade through winding or unwinding on and from the reels, respectively. This makes the wear relatively low, but at any rate completely uniform, and enables one to obtain a very long usage time of the scraper blade material.

These scraper blades are used as creping doctors and are set practically with their working edge against the paper, that is, against its direction of movement, thereby producing the crepe surface. Therefore, this scraper blade may be completely smooth and can readily be wound on a reel. There are no specific, elevated requirements regarding the fixing of the holder, which is arranged in the area of the web running across the backing roll.

Such a simple design is not possible in the case of doctor blades, because these are set in the direction of movement (web travel) of the paper web. Therefore, special provisions must be made for supporting the scraper blade. The winding of a longer doctor band also does not appear to be readily possible from the prior art.

BRIEF DESCRIPTION OF THE DRAWINGS

The invention will be explained hereinafter with the aid of the drawings.

FIG. 5, shows another embodiment, in principle and plan view;

FIG. 6, shows a detail of the embodiment shown in FIG. 5;

FIG. 7 shows another embodiment, in principle and plan view.

DESCRIPTION OF THE PREFERRED EMBODIMENT

Figure 3:
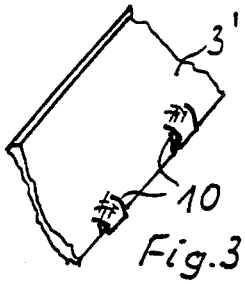
FIG. 3 shows a further detail of the doctor band.

Referring now to the drawings, doctor beam 2 is arranged on the backing roll 1. There is mounted or held in a doctor holder 4, a doctor 3 fashioned as a doctor blade bard, in such a way that it can move in its longitudinal direction but cannot escape in transverse direction. The doctor band 3 forms a loop, to the ends of which a rope 5 is attached that runs on a winding drum 6 or 7. Each of these drums can be driven by a motor, for instance an electric motor, and preferably a stepping motor.

Figure 2:
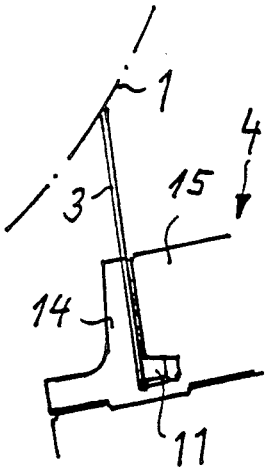
FIG. 2 shows in schematic representation, a side elevational view of the coating device of FIG. 1.
Figure 1:
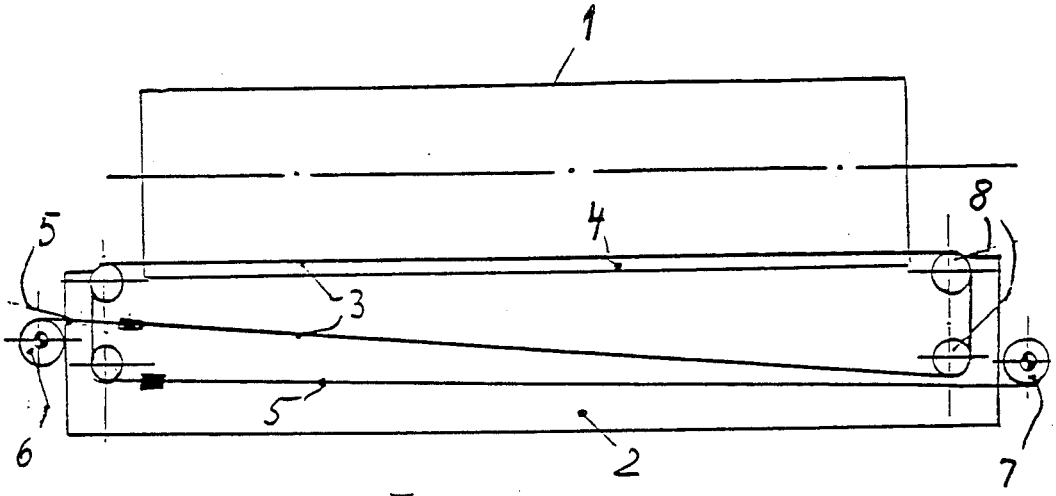
FIG. 1 shows as a first embodiment, a plan view of a coating device according to the present invention.
Figure 4:
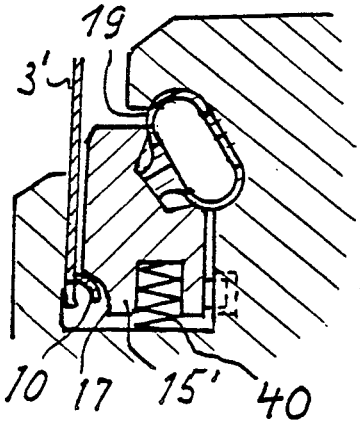
FIG. 4 shows as further detail, the doctor band in cross section.

The part of the loop of the doctor band 3 near the backing roll 1 which supports the paper web (not shown) runs parallel to the backing roll, and, as can be seen from FIG. 2 or 3, is held so as to be immovable in the direction of its width by means of a guide bar 15, and through projections 11 or bosses 10. Simple projections 11 may be fashioned on the one longitudinal edge of the doctor band also by soldering or welding. The guide bar 15' need not be designed for screw mounting in the doctor holder 4, but can be stressed across its length by a hydraulic pressure hose 19, tangentially to the backing roll 1 or somewhat away from it, so as to be forced with its guide faces 17 on the bosses 10, against the force of a number of cylindrical helical springs 40. The doctor band 3 is reliably secured thereby in the holder, with force being applied on the support bar 14 of the holder 4 (FIG. 4).

A thorough cleaning of the doctor band is possible by winding the doctor band 3 on a drum 7 or 6, or vice versa, at a very low speed of, for instance, 2 through 10 cm/min.

According to FIG. 5, a very long doctor band 5 is used which can be wound on drums 19, 20 that are arranged on both sides of the doctor beam 2. As the drums take up the doctor band 3' they are proportionally shifted, evenly, in the direction of their axis of rotation, i.e., in the direction of the width of the doctor band, for instance by being rotatably mounted on a lead screw 24 (FIG. 6). Thus, the doctor band can be wound on the drums, despite the bosses or projections, i.e., practically in the form of a helix or conchoid. The drive of the drums 19, 20 is provided best through a gear set 21, 22 by an electric motor 23 and by way of a spindle 25, for which a bearing 27 is provided which is held in place by a bearing block 28. Through its journal 26 and a bearing 29, the lead screw drives the spindle 25. In turn, the spindle 25 features a bearing 29 for a lower journal 26 of the lead screw 24.

FIG. 7 illustrates a setup where the doctor band 3'' forms a completely continuous loop which is formed by connecting the two ends of the doctor band by means of a lock 30. The loop can be tensioned through the tensioning roll 8', by means of piston rod 36 and piston 37 contained in the cylinder 35. Provided as a driving means is a cogqed belt 31 that runs in a loop by way of reversing pulleys 33 and drive pulleys 32 as well as idler pulley 34. The connection of cogged belt 31 and doctor band 3'' is indicated and provided for in the vicinity of the lock 30. This is a very favorable arrangement because only a single drive for the pulley 32 is needed which, however, needs to be of a variable design.

Cleaning devices for cleaning the doctor band are preferably provided outside the working area 39 of the doctor band or the backing roll 1. The first cleaning effect occurs through an overhang 38 of the backing roll, on which the doctor band bears through a straight line guide 4 and which is kept free of the web. Crusts that might form in the area of the contact edges of the doctor band on the paper web are scraped off here all the way.

Other suitable cleaning devices are those usually known in the art, such as pressurized jets that are discharged from nozzles and directed at the doctor band, as well as scrapers. Thus, after reversing the doctor band (reversal of its feed direction) a cleaned section of the doctor band is newly introduced in the working area.

The feed of the doctor band amounts to about 10 to 15 cm/min. Naturally, the doctor band is preferably cleaned prior to its take-up on the drums 6, 7 or 19, 20.

It will be appreciated that the foregoing is presented by way of illustration only, and not by way of any limitation, and that various alternatives and modifications may be made to the illustrated embodiment without departing from the spirit of the invention and the scope of the appended claims.

What is claimed is:

1. A coating device for the coating of a web supported by a backing roll, comprising:

a doctor band retained in a doctor holder which is supported by a doctor beam, said doctor beam having two ends with at least one reversing roll being provided at each of said ends, said doctor band forming a loop that extends between said at least one reversing roll on one end of said beam and said at least one reversing roll on the other end of said beam, said loop having two ends and having respective winding members attached to each end wherein each winding member runs on a respective winding drum, one of said winding drums being positioned at each end of said doctor beam, said doctor band having a working area along said backing roll for coating said web, said working area of said doctor band having two longitudinal ends and being movably held in a straightline doctor guide, said doctor band further having respective excess areas that border on and extend beyond each of said longitudinal ends of said working area, said doctor band being at least partly curved in said excess areas so as to limit said doctor band to an area having a length of maximally 1.6 times greater than the length of said straightline doctor guide; and drive means for feeding said doctor band in a longitudinal direction along said backing

2. A coating device as described in claim 1, wherein said drive means acts on at least one of said excess areas of said doctor band.

3. A coating device as described in claim 1, wherein said winding members comprise ropes, bands or wires.

4. A coating device as described in claim 1, wherein projections are arranged in a row generally parallel to a longitudinal edge of said doctor band for supporting the doctor band in said guide against movement by the doctor band in the direction of its width toward said backing roll, said doctor band being freely movable in a direction transverse to said backing roll.

5. A coating device as described in claim 1, wherein said winding drums are respectively positioned to the left and right of said doctor beam, and wherein a doctor band having a length three times greater than the length of said doctor beam is taken up by at least one of said drums, said at least one drum being rotatably driven and permitting continuous axial movement in the direction of the width of the doctor band.

6. A coating device as described in claim 4, wherein respective drums are positioned to the left and right of said doctor beam, and wherein a doctor band having a length three times greater than the length of said doctor beam can be taken up by at least one of said drums, said at least one drum being rotatably driven and permitting continuous axial movement in the direction of width of the doctor band.

7. A coating device as described in claim 5, wherein a lead screw is centrally provided as a carrier for said drums.

8. A coating device as described in claim 7, wherein said lead screw has a lower journal, and wherein a rotatably mounted spindle having a rotary drive coupled thereto and having a bearing point for said lower journal is provided as a drive for said drums.

9. A coating device as described in claim 1, in which said doctor band comprises a portion of an endless loop, said endless loop being in the form of a polygon train having two long trains opposing each other, wherein one of said trains is arranged in said working area of said doctor band and the other of said trains is coupled to said drive means.

10. A coating device as described in claim 9, in which said drive means is a cogged belt drive, said cogged belt being connected to said loop.

11. A coating device as described in claim 9, in which said doctor band loop has an adjustable idler pulley operatively connected thereto for reversing said doctor band loop.

12. A coating device as described in claim 10, in which said doctor band loop has an adjustable idler pulley operatively connected thereto for reversing said doctor band loop.

13. A coating device as described in claim 1, in which said doctor band is straight in said working area, and wherein said straight area extends beyond said longitudinal ends of said working area into said respective excess areas and substantially to respective ends of said backing roll, said backing roll being longer than said working area of said doctor band.

14. A coating device as described in claim 1, wherein devices for cleaning said doctor band are provided, said devices being situated outside said working area.

15. A coating device as described in claim 2, wherein devices for cleaning said doctor band are provided, said devices being situated outside said working area.

16. A coating device as described in claim 1, in which said doctor guide includes a clamping bar which is movable at least in the direction of the doctor band width and has guide faces, said coating device further including means for forcing said guide faces onto bosses or projections of said doctor band.

17. A coating device as described in claim 4, in which said doctor guide includes a clamping bar which is movable at least in the direction of the doctor band width and has guide faces, said coating device further including means for forcing said guide faces onto said projections.

18. A coating device as described in claim 16, wherein said means for forcing said guide faces comprises pneumatic or hydraulic cylinders, or a pneumatic or hydraulic hose.

19. A coating device as described in claim 1, wherein said doctor band and said drive means are mounted on said doctor beam.

20. A coating device as described in claim 4, wherein said doctor band and said drive means are mounted on said doctor beam.

21. A coating device as described in claim 6, wherein said doctor band and said drive means are mounted on said doctor beam.

22. A coating device as described in claim 8, wherein said doctor band and said drive means are mounted on said doctor beam.

23. A coating device for the coating of a web supported by a backing roll, comprising:

a doctor band retained in a doctor holder which is supported by a doctor beam, said doctor beam having two ends with at least one reversing roll being provided at each of said ends, said doctor band comprising a portion of an endless loop, said endless loop being in the form of a polygon train having two long trains opposing each other, wherein one of said trains is arranged in the working area of said doctor band and the other of said trains is coupled to a drive means, said loop extending between said at least one reversing roll on one end of said beam and said at least one reversing roll on the other end of said beam, said doctor band having a working area along said backing roll for coating said web, said working area of said doctor band having two longitudinal ends and being movably held in a straightline doctor guide, said doctor band further having respective excess areas that border on and extend beyond each of said longitudinal ends of said working area, said doctor band being at least partly curved in said excess areas so as to limit said doctor band to an area having a length of maximally 1.6 times greater than the length of said straightline doctor guide; and said drive means for feeding said doctor band along said backing roll.

24. The coating device of claim 23, wherein said drive means is a cogged belt.

* * * * *